US011828032B1

(12) United States Patent
Kim

(10) Patent No.: US 11,828,032 B1
(45) Date of Patent: Nov. 28, 2023

(54) FLEXIBLE LIQUID STORAGE DEVICE WITHIN A LARGER VOLUME OF LIQUID

(71) Applicant: Sun Yong Kim, Hayward, CA (US)

(72) Inventor: Sun Yong Kim, Hayward, CA (US)

( * ) Notice: Subject to any disclaimer, the term of this patent is extended or adjusted under 35 U.S.C. 154(b) by 0 days.

(21) Appl. No.: 18/308,220

(22) Filed: Apr. 27, 2023

Related U.S. Application Data

(60) Provisional application No. 63/359,855, filed on Jul. 10, 2022.

(51) Int. Cl.
*E02B 15/04* (2006.01)
*E02B 3/04* (2006.01)

(52) U.S. Cl.
CPC ..... *E02B 3/04* (2013.01)

(58) Field of Classification Search
CPC .... E02B 15/0814; E02B 15/06; E02B 15/045; E02B 2201/02; E02B 15/08; E02B 3/04; E02B 15/04
See application file for complete search history.

(56) References Cited

U.S. PATENT DOCUMENTS 3,599,434 A * 8/1971 Missud ..... E02B 15/08 405/60
3,640,073 A * 2/1972 Samsel ..... E02B 15/0885 405/72
3,744,254 A * 7/1973 Fennelly ..... E02B 15/08 405/62
3,839,870 A * 10/1974 Ryan ..... E02B 15/0878 405/64
3,984,987 A * 10/1976 Light, Jr. ..... E02B 3/00 405/63
4,335,977 A * 6/1982 Ihli ..... E03B 11/00 210/170.03
4,475,535 A * 10/1984 Assaf ..... F24S 10/13 165/45
4,735,524 A * 4/1988 Dunkers ..... E02B 3/00 405/63
5,071,286 A * 12/1991 Separovich ..... E02B 15/0885 405/72
6,660,170 B2 * 12/2003 Dreyer ..... E03B 3/04 210/931
6,918,349 B2 * 7/2005 Andersson ..... B63G 9/02 114/240 E
8,322,294 B2 * 12/2012 Bowhay ..... B63B 35/44 114/74 R
2001/0048851 A1 * 12/2001 Dreyer ..... E02B 15/0814 405/63

* cited by examiner

*Primary Examiner* — Carib A Oquendo
(74) *Attorney, Agent, or Firm* — Gerald R. Prettyman

(57) ABSTRACT

A flexible liquid separation media floats within an exterior liquid, e.g., body of water. At least three of a vertical outer support column are secured within the exterior liquid with upper connectors coupled to the flexible liquid separation media. A float within each of the at least three of a vertical outer support column are coupled to a lower portion of the flexible liquid separation media. The flexible liquid separation media is used to hold a contained liquid within the exterior liquid. The lower portion sinks and rises as the fluid level changes within the flexible liquid separation media while the floats within at least three of a vertical outer support column floatably anchors the lower portion and maintains the lower portion (105L) of the flexible liquid separation media (105) a consistent distance from the at least three of a vertical outer support column (120).

19 Claims, 6 Drawing Sheets

100
105
110
120
110
115
110
L
L
WF 110
120
200
175
180
185
230
105L 125
160
130
105
200
145
5
180
175
140
120
5
135
110
105L
230
185

FLEXIBLE LIQUID STORAGE DEVICE WITHIN A LARGER VOLUME OF LIQUID

CROSS-REFERENCE TO RELATED APPLICATION

This application claims the benefit of priority of U.S. Provisional Patent Application 63/359,855 filed Jul. 10, 2022 and titled "Large Volume Liquid Containment within a Liquid," the disclosure of which is incorporated by reference.

STATEMENT REGARDING FEDERALLY SPONSORED RESEARCH OR DEVELOPMENT

Not Applicable

BACKGROUND OF THE INVENTION

Field of Invention

The invention relates generally to large volume liquid storage facilities and more specifically to storage of large volumes of liquid with a larger volume of liquid.

Description of Related Art

As a life necessity, potable water is second only to breathable air. In the balance of life, however, floods and droughts seem to alternate, as alluded to by the phrases, "When it rains, it pours" and "It never rains in California, but girl don't they warn ya, It pours, man it pours." Chronic rains can cause floods, which like droughts, can mitigate crop yields and stress the health of biological organisms, and both floods and droughts can be regionally disastrous.

Flood mitigation relies significantly on levees and drainage canals, with some dam storage, but which have limited capacity, and interfere with local flora and fauna.

Drought mitigation relies significantly on reservoirs to capture and save water for regional and large community use, with storage tanks for downstream smaller communities. Reservoirs, while taking advantage of natural drainage paths such as valleys, require significant expense, and remove large acreage from use by local flora and fauna. In addition, water delivery often requires artificial waterways, e.g., canals, tunnels, and buried pipe lines, which greatly increase the delivery cost.

Additionally, both systems lack adequacy for cycles of drought and deluge, nor does either system facilitate a one-time or a periodic use of large natural or temporary bodies of water for holding significant volumes of rainwater, or for segregating non-aqueous liquids spilled on or within a body of water. Some estimates place rain water losses as exceeding 90 percent.

Some proposals suggest flooding vast regions during rainy seasons and allowing the water to percolate into groundwater. These "recharging" ideas of the massive nature ground water systems (aquifers) during rainy seasons would have been the best solution, had these be enacted before massive development and a multiple series of serious droughts and earth movement effectively blocked much of the ability of water to for retention and percolation of water to reach the deep underground locations that stored aquifer water. Even if geologically feasible, aquifer recharging will require erecting levees and other structures to prevent flooding of adjacent homes, parks, roads, etc.

Additional problems exist because run-off often contains dirt and organic debris, and with first and very heavy rains and floods, dangerous toxic contaminants that are not desired that could percolate into the aquifers.

SUMMARY OF THE INVENTION

A flexible liquid separation media (105) may be deployed within a body of exterior liquid (110) (e.g., sea water) on a temporary basis or a long-term basis for the capture and storage of a changeable volume of a contained liquid (115) (e.g., fresh water), or for segregating non-aqueous liquids spilled on or within a larger body of an exterior liquid.

The flexible liquid separation media (105) may be of an impermeable or substantially impermeable material to the exterior liquid (110) or to the contained liquid (115).

The at least three of a vertical outer support column (120) are secured via one or more couplers, or connectors to adjacent land anchors, or anchored or with embedded devices into the bed of the exterior liquid (110).

The at least three of a vertical outer support column (120) are connected to the flexible liquid separation media (105) to secure the flexible liquid separation media (105) within the exterior liquid (110).

The flexible liquid separation media (105) is an atmospherically open enclosure (i.e., an upper surface is not enclosed) enclosure with a liquid separation media upper edge (205) and a lower portion (105L) of the flexible liquid separation media (105) to contain the contained liquid (115) within the liquid separation media upper edge (205), which is within the exterior liquid (110), except for a media liquid flow barrier (210) (e.g., an upper portion) which is rises above the exterior liquid (110).

Each of the at least three of a vertical outer support column (120) has a liquid separation media support float (175) within a vertical float chamber (180) within each of the at least three of a vertical outer support column (120). Each liquid separation media support float (175) is connected to a lower separation media float coupler (185) which passes through a vertical slot (200) on a liquid separation media facing side (145) of each of the at least three of a vertical outer support column (120. Each lower separation media float coupler (185) is coupled to the lower portion (105L) of the flexible liquid separation media (105) such that liquid separation media support float (175) floatably anchors the lower portion (105L) of the flexible liquid separation media (105) within the exterior liquid (110), thereby mitigating current and swell effects on the flexible liquid separation media (105) and unequal liquid forces of weight and pressure of the contained liquid (115) upon the flexible liquid separation media (105).

As the contained liquid (115) fills the flexible liquid separation media (105), the lower portion (105L) of the flexible liquid separation media (105) sinks into the exterior liquid (110). The coupled lower separation media float coupler (185) caused the separation media support float (175) to sink within the vertical float chamber (180), but via the lower separation media float coupler (185), the separation media support float (175) keeps the lower portion (105L) of the flexible liquid separation media (105) a consistent distance relative to the at least three of a vertical outer support column (120).

DETAILED DESCRIPTION OF THE INVENTION

Figure 1:
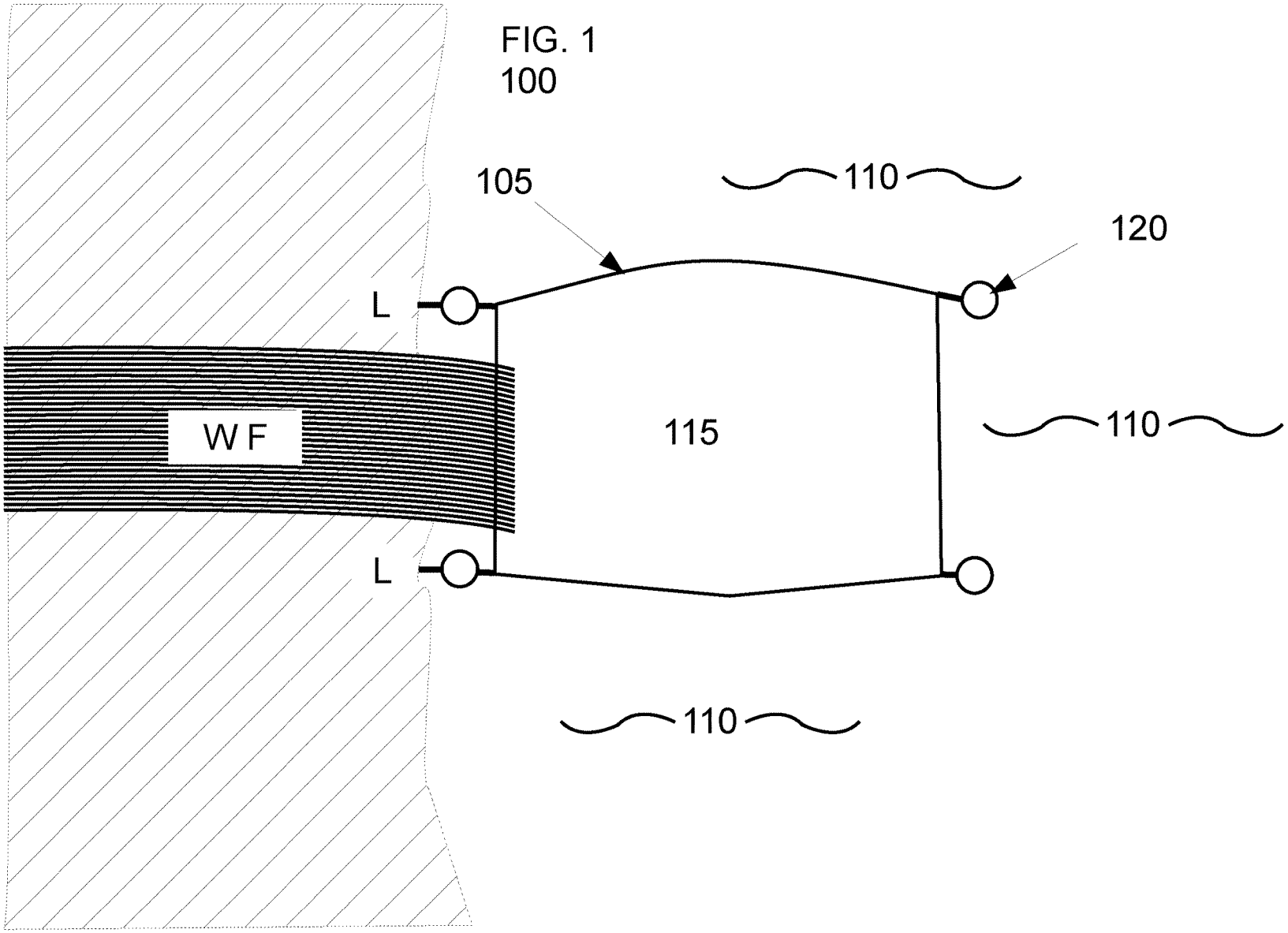
FIG. 1 shows a top view of a flexible liquid separation media (105) which may be an impermeable or substantially impermeable material deployed within an exterior liquid (110), for storage of a changeable volume of a contained liquid within a larger body of an exterior liquid, e.g., a body of sea water, for the capture and storage of a contained liquid (115), e.g., fresh water from a waterfall.

FIG. 1 shows a top view of a flexible liquid separation media (105) which may be an impermeable or substantially impermeable material deployed within an exterior liquid (110), e.g., a body of sea water, for the capture and storage of a contained liquid (115), e.g., fresh water from a waterfall.

Figure 3A:
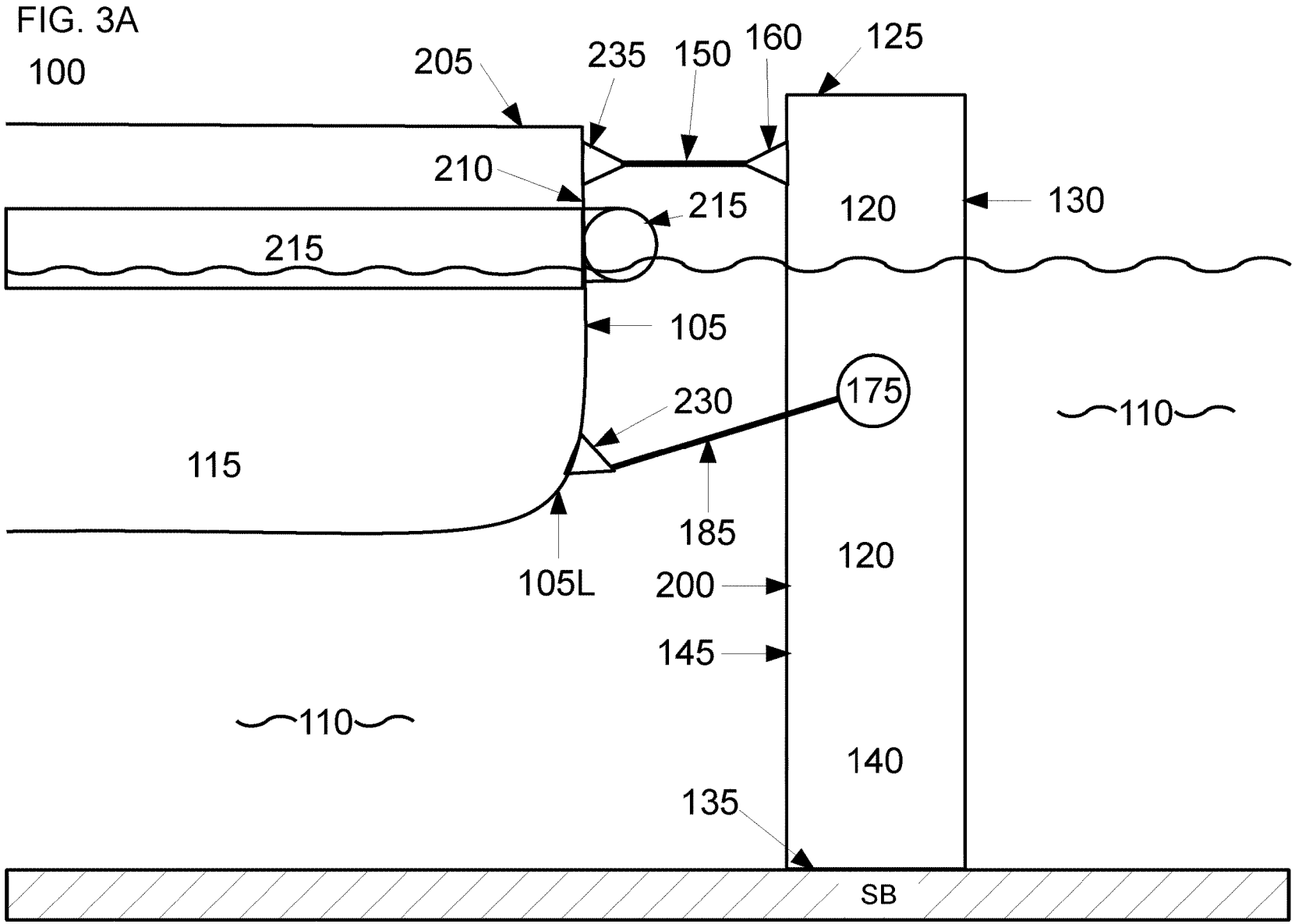
FIG. 3A shows an embodiment (100) of a partial side view of a flexible liquid separation media (105) partially deployed with a contained liquid (115) within the flexible liquid separation media (105) within a larger body of exterior liquid (110) with one of the at least three of a vertical outer support column (120) anchored to a bed (SB) of the exterior liquid (110).

The flexible liquid separation media (105) should be flexible so that the flexible liquid separation media (105) can (1) accommodate receiving a contained liquid (115) as the flexible liquid separation media (105) fills from an empty condition to a full condition, with a lower portion (105L) see FIG. 3A) of the flexible liquid separation media (105) sinking into the exterior liquid (110) and (2) flex when designed under conditions of swell, wave action, etc., and prevent unplanned transfers between the contained liquid (115) and the exterior liquid (110).

Shown in FIG. 1 are a waterfall (WF) projecting out from an embankment (shaded area) over an exterior liquid (110), e.g., sea water, into which is a flexible liquid separation media (105), which may be an impermeable or substantially impermeable material, for storage of a contained liquid (115) such as fresh water from waterfall (WB) in the flexible liquid separation media (105). Supporting the flexible liquid separation media (105) are at least three of a vertical outer support column (120), as described in more detail below.

In other applications, the flexible liquid separation media (105) of an impermeable or substantially impermeable material could be used to contain liquid contaminates as from spills and industrial pollution. The flexible liquid separation media (105) may be an impermeable or substantially impermeable material selected for an appropriate substantially impermeable property appropriate to retain the contained liquid (115) within the exterior liquid (110).

Many materials are suitable for fresh water and salt water applications. Suitable materials for aqueous use include polyvinylchloride (PVC), polypropylene (PP), polyethylene (PE), both in low density (LDPE) and high density (HDPE) compounds. For smaller operations, water storage tank liners and pond lines are available, many of these materials.

Some applications of the flexible liquid separation media (105) may use latex or rubber-compound, or other natural-based material, such as a cellulose-based material.

Other materials might be used for pollution control. The flexible liquid separation media (105) could be a polytetrafluoroethylene (PTFE) material, which is hydrophobic, highly inert, and durable. PTFE has a wide operating temperature range and resistance to the damaging effect of many chemicals.

The flexible liquid separation media (105) could be a polyvinylidene fluoride (PVDF) material, which is naturally hydrophobic and resistant to a broad range of organic solvents, but can be modified to a hydrophilic state.

The flexible liquid separation media (105) could be a nylon (NYL) material, which is also naturally hydrophilic with wide chemical compatibility and good resistance to organic solvents. This flexible liquid separation media (105) could be suitable for high-pH liquids.

The flexible liquid separation media (105) could be a polypropylene (PP) material, which is slightly hydrophobic and resistant to a broad range of chemicals and temperature.

The flexible liquid separation media (105) could be a polyethersulfone (PES) material, which is hydrophilic and suitable for high-pH applications.

The flexible liquid separation media (105) could be any material suitable for the osmotic and chemical conditions to contain the contained liquid (115) within the flexible liquid separation media (105) as to prevent migration of the contained liquid (115) or the exterior liquid (110) to the other liquid, as desired to be prevented.

The exterior liquid (110) may be a natural body of water, such as fresh water, a lake, a pond, etc., or sea water, or brine. The exterior liquid may be an artificial body of liquid, e.g., a holding pond.

The contained liquid (115) may be fresh water, which can be retrieved for use as non-potable water, or treated per community standards for potable water.

In some embodiments, the contained liquid (115) may be a liquid collected from the exterior liquid (110), such as fresh water or open (sea, etc.) water spills of contaminants. In some embodiments, the contained liquid (115) may be a liquid collected from a vessel or other container in or on the exterior liquid (110), such as open water (fresh or sea, etc.) spills or sinking of a vessel or other container with liquid that would be contaminants. In such an instance, the flexible liquid separation media (105) can and should be selected per the chemical properties of the contaminants to contain the contaminants.

The flexible liquid separation media (105) is sufficiently flexible to withstand environmental effects of the exterior liquid (110) and pressure of the contained liquid (115) while filling and holding the contained liquid (115).

Figure 2:
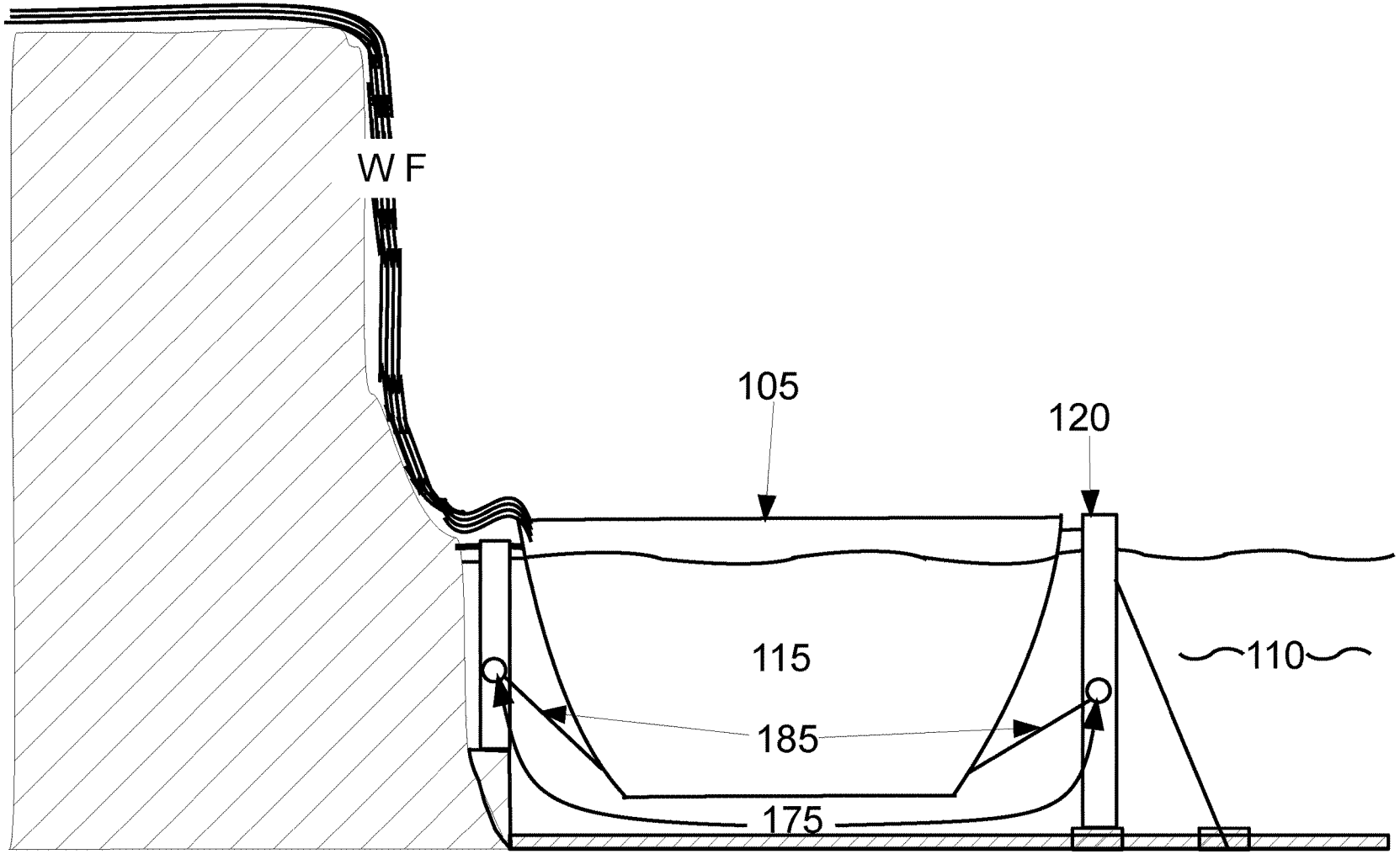
FIG. 2 shows a partial (some components omitted for clarity of purpose) side view of a flexible liquid separation media (105) deployed within a large body of an exterior liquid (110), e.g., sea water for the capture and storage of a contained liquid (115), e.g., fresh water from a waterfall (WF).

FIG. 2 shows a partial (some components omitted for clarity of purpose) side view of a flexible liquid separation media (105) deployed within a large body of exterior liquid (110), e.g., water for the capture and storage of a contained liquid (115), e.g., water from a waterfall (WF).

Shown in FIG. 2 are the flexible liquid separation media (105) deployed within a large body of exterior liquid (110, e.g., water) for the capture and storage of contained liquid (115), as from a waterfall (WF). Supporting the flexible liquid separation media (105) are at least three of a vertical outer support column (120), which as shown in FIG. 2, and as described below in detail, are affixed to secure the flexible liquid separation media (105) in position within the exterior liquid (110). The at least three of a vertical outer support column (120) may be affixed, depending on location as shown in FIG. 2, to a land position by one or more mooring anchors, or by other anchor devices, set within the earth (i.e., lake bed, sea bed) below the exterior liquid, or by one or more sea anchors, as described below.

The at least three of a vertical outer support column (120), as described below in more detail, are substantially hollow (see vertical float chamber (180) below), within each of which is a liquid separation media support float (175), each of which is attached to a lower portion (105L) of the flexible liquid separation media (105) via a lower separation media float coupler (185). Each of the at least three of a vertical outer support column (120) are substantially hollow to allow the liquid separation media support float (175) to move freely up and down within the at least three of a vertical outer support column (120).

The at least three of a vertical outer support column (120) may be round, square, triangular, hexagonal, other geometric shape, symmetrical, or non-symmetrical. As described herein, the at least three of a vertical outer support column (120) directly supports the substantially flexible liquid separation media (105) via upper couplers, and indirectly supports the substantially flexible liquid separation media (105) via lower couplers, which reside within a vertical float chamber (180) within the at least three of a vertical outer support column (120).

The at least three of a vertical outer support column (120) may be made of any material that is sufficiently durable for directly supporting the substantially flexible liquid separation media (105) via upper couplers and for indirectly supporting the substantially flexible liquid separation media (105) via lower couplers coupled to the liquid separation media support float (175), which reside within a vertical float chamber (180) (i.e., the substantially hollow portion) within the at least three of a vertical outer support column (120) and for supporting each vertical outer support column (120) in its affixed location via the various affixment mechanisms, such as seabed attachment, sea anchors, and land anchors. Similar to the substantially flexible liquid separation media (105), the at least three of a vertical outer support column (120) might be modified for resistance to corrosive chemicals. The at least three of a vertical outer support column (120) may be made of polyvinyl chloride (PVC). The strength of the PVC would depend on the situation and location. A small and shallow location might use schedule 20 PVC, while larger or deeper locations might require PVC of schedule 40, schedule 80, or schedule 120. Some locations may require the at least three of a vertical outer support column (120) be made of metal, e.g., aluminum, a steel alloys, or other metal. Some applications of the at least three of a vertical outer support column (120) may use wood, subject to sizing and reinforcement as required for additional details below. The at least three of a vertical outer support column (120) may be made of concrete for applications in open waters of exterior liquid (110) for better resistance to swells, and natural and artificial hazards.

Each of the at least three of a vertical outer support column (120) may have any diameter suitable for securing each of the at least three of a vertical outer support column (120) within an exterior liquid (110) to support a substantially flexible liquid separation media (105) holding a contained liquid (115). The at least three of a vertical outer support column (120) may have a two-inch (2 inches) diameter or more for small holding ponds, or a diameter of six or more inches, including of over 12 inches to more than 24 inches in diameter for larger bodies of exterior liquid (110).

FIG. 3A shows an embodiment (100) of a partial side view of a flexible liquid separation media (105) partially deployed with a contained liquid (115) within the flexible liquid separation media (105) within a larger body of exterior liquid (110) with one of the at least three of a vertical outer support column (120) anchored to a bed (SB) of the exterior liquid (110).

Shown in FIG. 3A are a flexible liquid separation media (105), a lower portion (105L) of flexible liquid separation media (105), an exterior liquid (110), a contained liquid (115), at least three of a vertical outer support column (120), a top end (125) of the at least three of a vertical outer support column (120), an upper end (130) of the at least three of a vertical outer support column (120), a bottom end (135) of the at least three of a vertical outer support column (120), a lower end (140) of the at least three of a vertical outer support column (120), a liquid separation media facing side (145), an upper media support column connector (150), at least one support column coupler (160), a liquid separation media support float (175), a lower separation media float coupler (185), a vertical slot (200) of the at least three of a vertical outer support column (120), a liquid separation media upper edge (205), a media liquid flow barrier (210), an upper horizontal support float (215), a changeable volume (220), a lower media coupler (230), an upper affixment (235) of the flexible liquid separation media (105), and a sea-bed anchor (SB).

A top end (125) of the at least three of a vertical outer support column (120) provided multiple functions. The top end (125) of the at least three of a vertical outer support column (120) may provide a mooring point for affixment of the at least three of a vertical outer support column (120) to a securing media (170). The top end (125) of the at least three of a vertical outer support column (120) may provide a mooring point for securing in place of the flexible liquid separation media (105) via affixment devices, discussed below. The top end (125) of the at least three of a vertical outer support column (120) provides a visualization point of the at least three of a vertical outer support column (120). The top end (125) of the at least three of a vertical outer support column (120) may be covered to contain the liquid separation media support float (175) within the vertical outer support column (120) against waves and swell action. The top end (125) of the at least three of a vertical outer support column (120) may provide a staging area for attachment of monitors, sensors, ancillary equipment, e.g. batteries, flags, etc., to at least one at least three of a vertical outer support column (120). The top end (125) of the at least three of a vertical outer support column (120) will be subjected the elements, as well to the exterior liquid (110), and may require protective covering.

The upper end (130) of the at least three of a vertical outer support column (120) is proximate to (i.e., below when the at least three of a vertical outer support column (120) are installed in the exterior liquid (110)) and supports the top end (125) of the at least three of a vertical outer support column (120) so that the top end (125) of the at least three of a vertical outer support column (120) is above the exterior liquid (110). The upper end (130) of the at least three of a vertical outer support column (120) may provide a mooring point for affixment of the at least three of a vertical outer support column (120) to a securing media (170). The upper end (130) of the at least three of a vertical outer support column (120) may provide a mooring point for securing in place of the flexible liquid separation media (105) via affixment devices, discussed below. Like the top end (125) of the at least three of a vertical outer support column (120), the top end (125) of the at least three of a vertical outer support column (120) will be subjected the elements, as well to the exterior liquid (110), and may require protective covering.

A bottom end (135) of the at least three of a vertical outer support column (120) supports the vertical outer support column (120). The bottom end (135) of the at least three of a vertical outer support column (120) may provide a location for a securing mechanism of at least one of the at least three of a vertical outer support column (120) to whatever is below it (lakebed, seabed), or to its side (mooring anchor, land). The bottom end (135) of the at least three of a vertical outer support column (120) may provide a mooring point for affixment of the at least three of a vertical outer support column (120) to a securing media (170). The bottom end (135) of the at least three of a vertical outer support column (120) may have a more robust construction higher portions of the vertical outer support column (120). The bottom end (135) of the at least three of a vertical outer support column (120) may have added weight for stability.

The lower end (140) of the at least three of a vertical outer support column (120) supports the sections of the vertical outer support column (120) above it, specifically the liquid separation media facing side (145), and a vertical slot (200) of the at least three of a vertical outer support column (120), as well as the upper end (130) and (top end (125). The lower end (140) is proximate (i.e., above when the at least three of a vertical outer support column (120) are installed in the exterior liquid (110)) to the bottom end (135) and may provide a mooring point for affixment of one or more the at least three of a vertical outer support column (120) to a securing media (170).

A liquid separation media facing side (145) is between the lower end (140) of the at least three of a vertical outer support column (120) and the upper end (130) of the at least three of a vertical outer support column (120). As the name suggests, the liquid separation media facing side (145) faces the flexible liquid separation media (105). This orientation thereby places the lower separation media float coupler (185), and it's attached liquid separation media support float (175), in line via a vertical slot (200) of the at least three of a vertical outer support column (120) to the lower media coupler (230) affixed to the lower portion (105L) of the flexible liquid separation media (105). See FIGS. 4 and 5.

An upper media support column connector (150) functions to couple the flexible liquid separation media (105) to the at least three of a vertical outer support column (120), typically via one or more securing devices. The upper media support column connector (150) may be inflexible, or more or less inflexible based upon the circumstances of the exterior liquid (110), the flexible liquid separation media (105), and the presence and properties of the securing devices, if any. A metal rod could be an example of an inflexible type of an upper media support column connector (150). A rubber cord could be an example of a flexible type of an upper media support column connector (150). A plastic cord could be an example of a more or less flexible type of an upper media support column connector (150).

An at least one support column coupler (160) operates to couple each of the at least three of a vertical outer support column (120) to the flexible liquid separation media (105) and the securing media (170) via a connector, e.g., the upper media support column connector (150) and the support column upper securing media connector (165). The at least one support column coupler (160) may be inflexible, such as a metal bracket affixed to the each of the at least three of a vertical outer support column. The at least one support column coupler (160) may be flexible, or more or less flexible. The at least one support column coupler (160) may be made of rubber, such as a bracket, bumper, buckle, clamp, or other coupler. The upper media support column connector (150) may be made of plastic, such as a bracket, bumper, buckle, clamp, or other coupler. The at least one support column coupler (160) may be separate or integrated into the vertical outer support column (120) or the connector, i.e., an upper media support column connector (150) or a support column upper securing media connector (165).

A liquid separation media support float (175) rests within each of the at least three of a vertical outer support column (120) and is connected via one or more coupling devices to a lower portion (105L) of flexible liquid separation media (105). Via this coupling, each liquid separation media support float (175) rests within one of the at least three of a vertical outer support column (120) and rises and falls within the respective one of the at least three of a vertical outer support column (120) based on the weight of contained liquid (115) within the flexible liquid separation media (105). The liquid separation media support float (175) may be a material of a density less than the exterior liquid (110), such as plastic, or wood. The liquid separation media support float (175) may be a hollow object, a solid object, or a partially hollow and partially solid object. The liquid separation media support float (175) may be made of a hollow plastic material, open-cell plastic foam, or closed-cell plastic foam. The liquid separation media support float (175) may have a ball shape or an oval shape. Other shapes may be used. The liquid separation media support float (175) may be made of plastic, wood, metal, or of any material fabricated to rest within a vertical outer support column (120) and connected via one or more coupling devices to a lower portion (105L) of flexible liquid separation media (105), and to rise and fall within the respective one of the at least three of a vertical outer support column (120) based on the weight of contained liquid (115) within the flexible liquid separation media (105). The liquid separation media support float (175) may have a size of less than 2 inches, i.e., to fit and float within a somewhat larger vertical outer support column (120). The liquid separation media support float (175) may have a size of more than 2 inches, i.e., 4 inches, 6 inches, or even of 23 inches, for a 24 inches or larger diameter of at least one of the at least three of a vertical outer support column (120).

A lower separation media float coupler (185) functions to couple the liquid separation media support float (175) to the flexible liquid separation media (105). The lower separation media float coupler (185) passes through a vertical slot (200) of each of the at least three of a vertical outer support column (120) for coupling the liquid separation media support float (175) to a lower media coupler (230) affixed to the lower portion (105L) of the flexible liquid separation media (105) for the liquid separation media support float (175) to floatably anchor the lower portion (105L) of the flexible liquid separation media (105) a consistent distance relative to the respective one of the at least three of a vertical outer support column (120) so the lower portion (105L) sinks and rises without varying in horizontal distance from the one of the at least three of a vertical outer support column (120) to which the lower portion (105L) is floatably anchored. The coupling of the lower separation media float coupler (185) to the liquid separation media support float (175) and to the lower portion (105L) of the flexible liquid separation media (105) may be direct or may be indirect via one or more coupling devices. The lower separation media float coupler (185) may be inflexible or more or less inflexible based upon whether the exterior liquid (110) is static or dynamic, the relative buoyancy of the liquid separation media support float (175), the durability of the flexible liquid separation media (105) relative to the conditions, and the presence and properties of other securing devices, if any. The lower separation media float coupler (185) may be a metal rod, i.e., generally inflexible. A rubber cord could be an example of a flexible lower separation media float coupler (185). A plastic cord could be an example of a more or less flexible lower separation media float coupler (185).

Figures 4, 5:
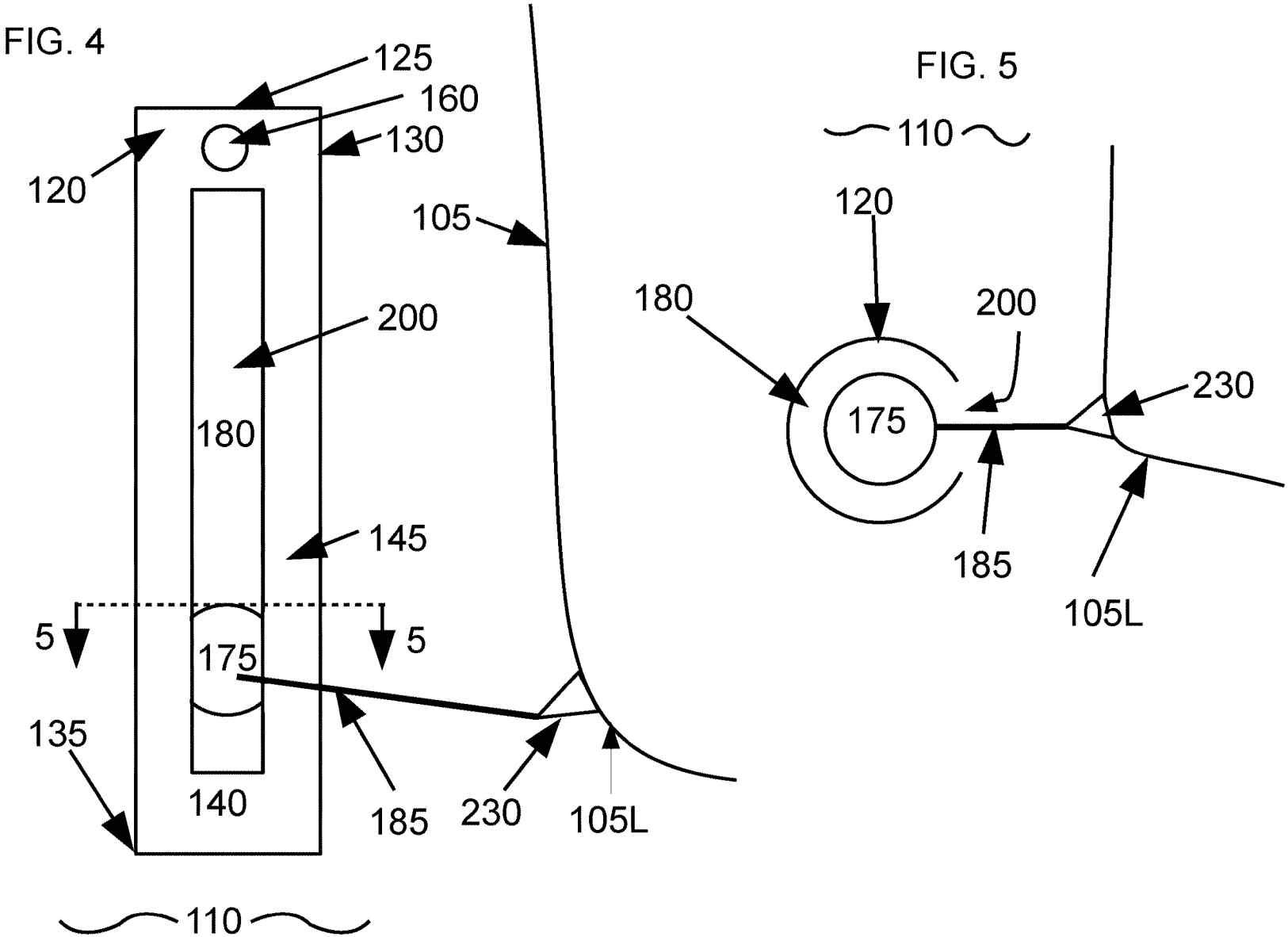
FIG. 4 shows a front view of one of the at least three of a vertical outer support column (120) as seen from the flexible liquid separation media (105).
FIG. 5 shows a top view of a one of the at least three of a vertical outer support column (120) within exterior liquid (110) with a liquid separation media support float (175) affixed to a lower portion (105L) of a flexible liquid separation media (105)

A vertical slot (200) of the at least three of a vertical outer support column (120) is present on the liquid separation media facing side (145). The vertical slot (200), which is shown in FIG. 4 and FIG. 5, is a channel for the lower separation media float coupler (185) to couple the liquid separation media support float (175) to the lower portion (105L) of the flexible liquid separation media (105). The vertical slot (200) of the at least three of a vertical outer support column (120) is present on the liquid separation media facing side (145) of the at least three of a vertical outer support column (120) between the upper end (130) of the at least three of a vertical outer support column (120) and the lower end (140) of the at least three of a vertical outer support column (120).

A liquid separation media upper edge (205) and a media liquid flow barrier (210) are present on the flexible liquid separation media (105) above the exterior liquid (110) and the contained liquid (115). The liquid separation media upper edge (205) and the media liquid flow barrier (210) function to retain the contained liquid (115) from transiting from the flexible liquid separation media (105) into the exterior liquid (110) and similarly function to retain the exterior liquid (110) from transiting in the contained liquid (115).

The liquid separation media upper edge (205) may be fabricated from the same material as the flexible liquid separation media (105). The liquid separation media upper edge (205) may be fabricated from a material different from the flexible liquid separation media (105), i.e., to provide additional retaining and loss mitigation functions.

A media liquid flow barrier (210) is present on an exterior side of the flexible liquid separation media (105) below the liquid separation media upper edge (205) and functions to retain the contained liquid (115) and the exterior liquid (110) from commingling by one or the other transiting over the liquid separation media upper edge (205). The media liquid flow barrier (210) also functions as an affixment location and support for an upper horizontal support float (215) and an upper affixment (235) of the flexible liquid separation media (105).

The media liquid flow barrier (210) may be fabricated from the same material as the flexible liquid separation media (105). The media liquid flow barrier (210) may be fabricated from a material different from the flexible liquid separation media (105) to provide additional containment strength for the flexible liquid separation media (105).

Figure 3B:
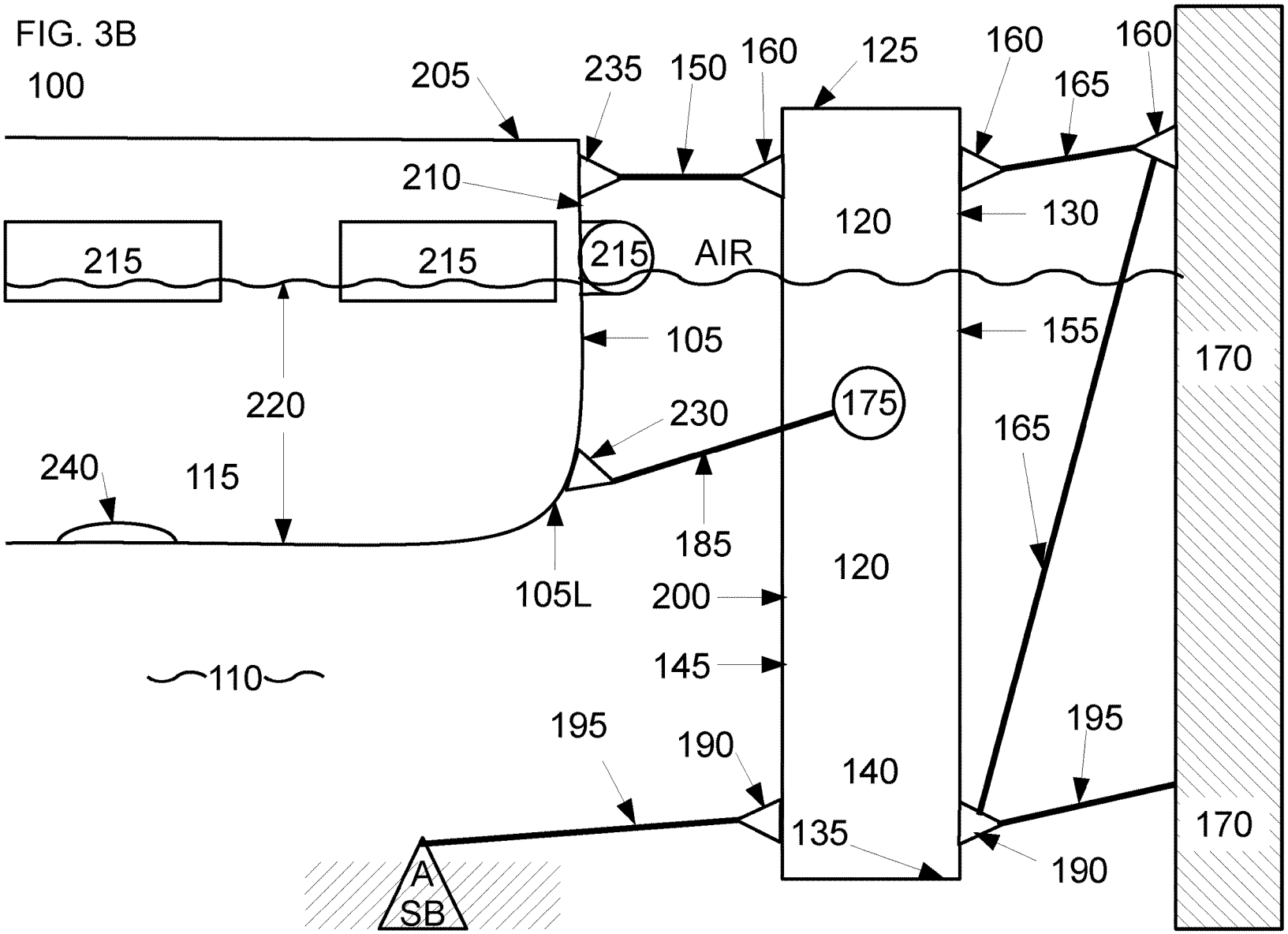
FIG. 3B shows an embodiment (100) of a partial side view of a flexible liquid separation media (105) with one of the at least three of a vertical outer support column (120) anchored to a land mass type of a securing media (170) adjacent to the exterior liquid (110).

An upper horizontal support float (215) provides flotation support to the media liquid flow barrier (210) to keep the liquid separation media upper edge (205) above the liquid level of the exterior liquid (110) and the contained liquid (115). The upper horizontal support float (215) may be continuous around the flexible liquid separation media (105), as shown in FIG. 3A. The upper horizontal support float (215) may be present in discrete sections around the flexible liquid separation media (105), as shown in FIG. 3B. The upper horizontal support float (215) may be made of any material suitable to provide flotation support to keep the liquid separation media upper edge (205) above the liquid level of the exterior liquid (110) and the contained liquid (115). The upper horizontal support float (215) may be a natural material such as wood, kelp bulbs, rubber floatation devices, or other buoyant natural materials. The upper horizontal support float (215) may be an artificial material such as hollow plastic piping, closed-cell foam, open-cell foam, or other buoyant artificial material.

A lower media coupler (230) couples the lower portion (105L) of the flexible liquid separation media (105) with a lower separation media float coupler (185). The lower media coupler (230) is within the exterior liquid (110) and may subject to currents, swells, and biological interactions. The lower media coupler (230) may be made of the same material as the flexible liquid separation media (105). The lower media coupler (230) may be inflexible, more or less flexible, or flexible. The lower media coupler (230) may be made of a material different than the flexible liquid separation media (105). The lower media coupler (230) may be made of a natural material such as wood or rubber. The lower media coupler (230) may be made of an artificial material, such plastic, i.e., PVC, nylon, PE, PP, or other plastic. The lower media coupler (230) may be configured as a bracket, bumper, buckle, clamp, or other coupler. The lower media coupler (230) may be separate from, or integrated into the lower separation media float coupler (185).

An upper affixment (235) of the flexible liquid separation media (105) couples the media liquid flow barrier (210) of the flexible liquid separation media (105) with the upper media support column connector (150). The upper affixment (235) may be made of the same material as the flexible liquid separation media (105). The upper affixment (235) may be inflexible, more or less flexible, or flexible. The upper affixment (235) may be made of a material different than the flexible liquid separation media (105). The upper affixment (235) may be made of a natural material such as wood or rubber. The upper affixment (235) may be made of an artificial material, such plastic, i.e., PVC, nylon, PE, PP, or other plastic. The upper affixment (235) may be configured as a bracket, bumper, buckle, clamp, or other coupler. The upper affixment (235) may be separate from, or integrated into the upper media support column connector (150).

FIG. 3B shows an embodiment (100) of a partial side view of a flexible liquid separation media (105) with one of the at least three of a vertical outer support column (120) anchored to a land mass type of a securing media (170) adjacent to the exterior liquid (110).

Shown in FIG. 3B are a flexible liquid separation media (105), an exterior liquid (110), a contained liquid (115), one of at least three of a vertical outer support column (120), a top end (125) of the at least three of a vertical outer support column (120), an upper end (130) of the at least three of a vertical outer support column (120), a bottom end (135) of the at least three of a vertical outer support column (120), a lower end (140) of the at least three of a vertical outer support column (120), a liquid separation media facing side (145), an upper media support column connector (150), a securing media facing side (155), at least one support column coupler (160), a support column upper securing media connector (165), a securing media (170), a liquid separation media support float (175), a lower separation media float coupler (185), a lower lateral support coupler (190), a lower securing media coupling connector (195), a liquid separation media upper edge (205), a media liquid flow barrier (210), an upper horizontal support float (215), a settled solids discharge mechanism (225), a.k.a. sludge drain, a changeable volume (220), a lower media coupler (230), an upper affixment (235) of the flexible liquid separation media (105), at least one weight (240), a sea-bed anchor (SB), and a lower portion (105L) of flexible liquid separation media (105).

A securing media facing side (155) faces the securing media (17) from between the lower end (140) of the at least three of a vertical outer support column (120) and the upper end (130) of the at least three of a vertical outer support column (120) and is opposite from the liquid separation media facing side (145). With the securing media facing side (155) opposite the liquid separation media facing side (145), the vertical outer support column (120) is aligned with a lower separation media float coupler (185) aligned to the flexible liquid separation media (105) and a support column upper securing media connector (165) aligned to the securing media (170). This assures that the vertical outer support column (120) will not encumber nor apply undue stress to the lower separation media float coupler (185) nor the support column upper securing media connector (165).

A support column upper securing media connector (165) functions to couple each of the at least three of a vertical outer support column (120) to a securing media (170) typically via one or more securing devices affixed to one or more of each of the at least three of a vertical outer support column (120) and the securing media (170). The support column upper securing media connector (165) may be inflexible, or more or less inflexible based upon the circumstances of the exterior liquid (110), the securing media (170), and the presence and properties of other securing devices, if any. A metal rod could be an example of an inflexible type of a support column upper securing media connector (165). A rubber cord could be an example of a flexible type of a support column upper securing media connector (165). A plastic cord could be an example of a more or less flexible type of a support column upper securing media connector (165).

A securing media (170) provides an immovable affixment for each of the at least three of a vertical outer support column (120), and the flexible liquid separation media (105) via the various couplers. The securing media (170) may be a land mass having an elevation above the exterior liquid (110). The securing media (170) may be a land mass adjacent to the exterior liquid (110). Affixment to the securing media (170) may be direct, or indirect, via an embedded device, which may be of concrete construction, or of wood, metal, embedded stone, or naturally present stone. Affixment to the securing media (170) may be by use of weighted masses, which may be of concrete construction, embedded stone, or naturally present stone.

FIG. 3B also show a lower lateral support coupler (190) which is an option to aid in securing one or more or at least three of a vertical outer support column (120) to a securing media (170). A lower lateral support coupler (190) may be separate from, or may be integrated into one or more or at least three of a vertical outer support column (120). The lower lateral support coupler (190) may be inflexible, such as a metal bracket affixed to the each of the at least three of a vertical outer support column (120). The lower lateral support coupler (190) may be flexible, or more or less flexible. The lower lateral support coupler (190) may be made of rubber, such as a bracket, bumper, buckle, clamp, or other coupler. The upper media support column connector (150) may be made of plastic, such as a bracket, bumper, buckle, clamp, or other coupler. The upper media support column connector (150) may be made of metal, such as a bracket, bumper, buckle, clamp, or other coupler. The lower lateral support coupler (190) may be separate or integrated into one or more of the at least three of a vertical outer support column (120) or into a lower lateral support coupler (190).

A lower securing media coupling connector (195) may aid to couple at least one of the at least three of a vertical outer support column (120) to a securing media (170). The lower securing media coupling connector (195) may be inflexible, or more or less flexible based upon the circumstances of the exterior liquid (110), the flexible liquid separation media (105), and the presence and properties of the other securing devices, if any. The lower securing media coupling connector (195) might be an inflexible metal rod or other metal device to aid in connecting at least one of the at least three of a vertical outer support column (120) to a securing media (170). The lower securing media coupling connector (195) might be a slightly flexible wood or plastic piece, i.e., rod or other device to aid in connecting at least one of the at least three of a vertical outer support column (120) to a securing media (170). The lower securing media coupling connector (195) might be a flexible plastic piece, i.e., rod or other device to aid in connecting at least one of the at least three of a vertical outer support column (120) to a securing media (170). The lower securing media coupling connector (195) might be a plastic cord or other cord material to aid in connecting at least one of the at least three of a vertical outer support column (120) to a securing media (170).

An at least one weight (240) may be used to counter situations when (1) the exterior liquid (110) and contained liquid (115) are of different densities, or (2) the flexible liquid separation media (105) is too buoyant or dense with respect to the exterior liquid (110) or the contained liquid (115). The at least one weight (240) may a liquid such as water or other liquid, or a solid, including metal, rocks, wood, or a solid with entrained air, such as open-cell foam or closed-cell foam as suitable for negative buoyancy. The at least one weight (240) may be used to mitigate unequal liquid forces of weight and pressure of the exterior liquid (110) and the contained liquid (115) on the flexible liquid separation media (105).

A sea-bed anchor (SB) may be a natural material, such as rock or bed rock, or may be an artificial anchor, such as concrete or metal, or may an artificial material embedded into a natural material.

Figure 3C:
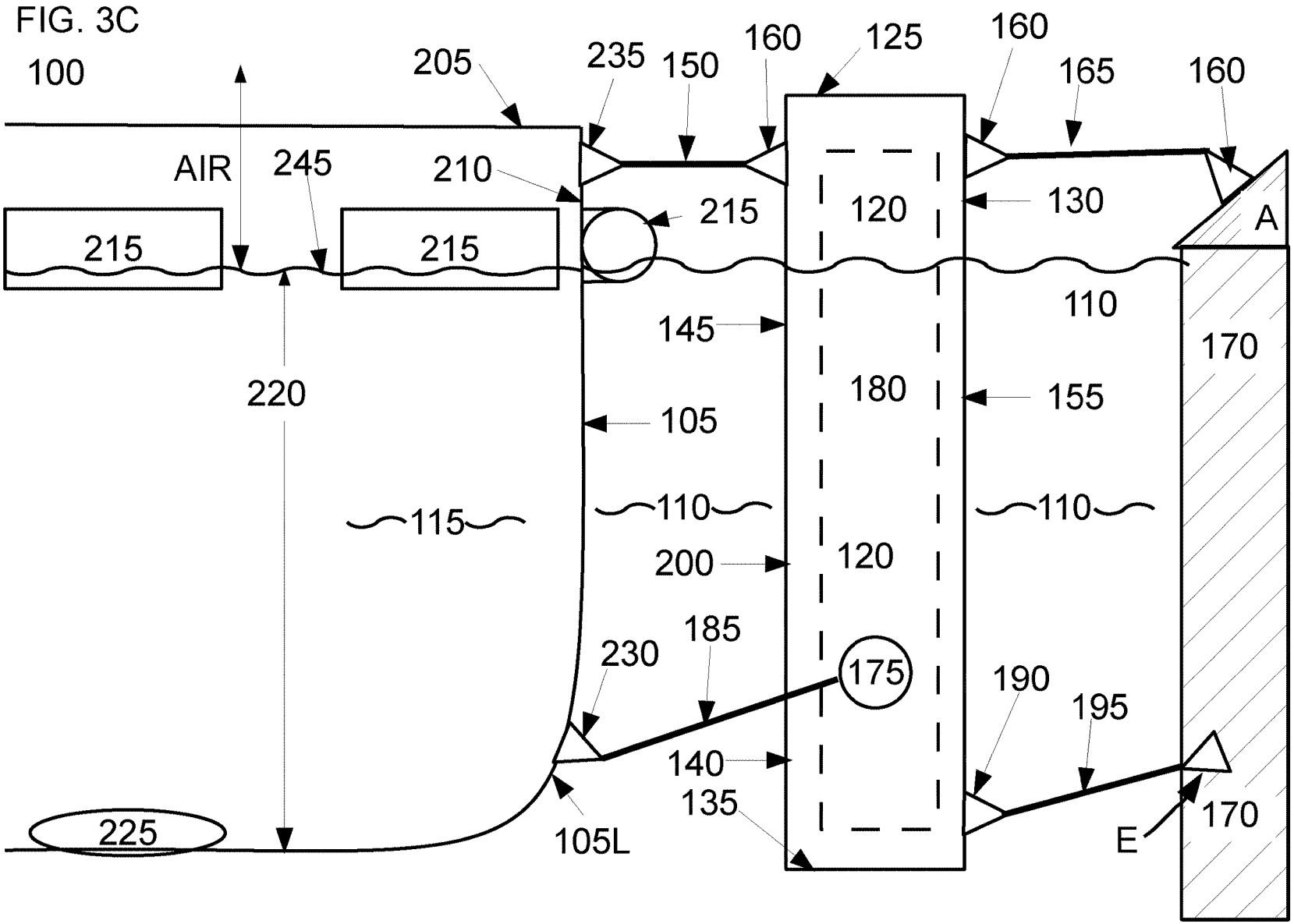
FIG. 3C shows a partial side view of an embodiment (100) of a contained liquid (115) within a flexible liquid separation media (105) fully deployed within exterior liquid (110) with one of the at least three of a vertical outer support column (120) anchored to securing media (170), i.e., an adjacent land mass.

FIG. 3C shows a partial side view of an embodiment (100) of a contained liquid (115) within a flexible liquid separation media (105) fully deployed within exterior liquid (110) with one of the at least three of a vertical outer support column (120) anchored to securing media (170), i.e., an adjacent land mass.

Shown in FIG. 3C are a changeable volume (220) of contained liquid (115) and a settled solids discharge mechanism (225), a.k.a. sludge drain, a land anchor (A) and an embedded anchor (E) in securing media (170), and a surface (245) of the contained liquid (115) for an atmospherically open enclosure.

A changeable volume (220) refers to a change in volume of contained liquid (115) within the flexible liquid separation media (105), as a contained liquid (115) is directed into, or removed from, the flexible liquid separation media (105).

For the flexible liquid separation media (105) to be flexible, the flexible liquid separation media (105) is capable of, i.e., should be able to accommodate, a changeable volume (220) of increasing and decreasing volumes of contained liquid (115) so that at the surface (245) of the contained liquid (115) at the atmospheric interface (AIR) and the exterior liquid (110), i.e., the levels of the contained liquid (115) and the exterior liquid (110), are level to each other as the volume of contained liquid (115) changes within the flexible liquid separation media (105). Compare FIG. 3B to 3C. In this way, the lower portion (105L) of the flexible liquid separation media (105) changes depth within the exterior liquid (110) to accommodate the changeable volume (220) of contained liquid (115), and the contained liquid (115) maintains a consistent difference below the liquid separation media upper edge (205) of the flexible liquid separation media (105).

Consequently, the lower portion (105L) of the flexible liquid separation media (105) sinks in the exterior liquid (110) as the changeable volume (220) of the contained liquid (115) increases within the flexible liquid separation media (105) and the lower portion (105L) of the flexible liquid separation media (105) rises in the exterior liquid (110) as the changeable volume (220) of the contained liquid (115) decreases within the flexible liquid separation media (105).

A solids discharge mechanism (225) is an optional structure on the lower portion (105L) of the flexible liquid separation media (105) for manually or automatically discharging (where permissible) heavy solutes, solids, or both from the flexible liquid separation media (105).

The solids discharge mechanism (225) may be manually operated, either directly, or remotely, as by a manually actuated valve on the lower portion (105L) of the flexible liquid separation media (105), or a manually actuated spring-loaded vertical discharge port.

The solids discharge mechanism (225) may be actuated by a weight or pressure difference of solids or heavy solutes on the solids discharge mechanism (225) compared to the pressure of the exterior liquid on the underside of the solids discharge mechanism (225). The solids discharge mechanism (225) may be one or more springs within the solids discharge mechanism (225), or may be one or more springs on the outside of the solids discharge mechanism (225).

One or more of the at least three of a vertical outer support column (120) may be anchored via a land anchor (A) on securing media (170). One or more of the at least three of a vertical outer support column (120) may be anchored via an embedded anchor (E) in the securing media (170).

FIG. 4 shows a front view of one of the at least three of a vertical outer support column (120) as seen from the flexible liquid separation media (105).

Shown in FIG. 4 are a flexible liquid separation media (105), a lower portion (105L) of the flexible liquid separation media (105), one of an at least three of a vertical outer support column (120), a top end (125) of the at least three of a vertical outer support column (120), an upper end (130) of the at least three of a vertical outer support column (120), a bottom end (135) of the at least three of a vertical outer support column (120), a lower end (140) of the at least three of a vertical outer support column (120), a liquid separation media facing side (145), at least one support column coupler (160), a liquid separation media support float (175), a lower separation media float coupler (185), and a lower media coupler (230) between the lower separation media float coupler (185), the flexible liquid separation media (105), and a lower portion (105L) of flexible liquid separation media (105).

The at least one support column coupler (160) is above the vertical slot (200) of the at least three of a vertical outer support column (120) to position the vertical outer support column (120) so that the vertical slot (200) faces the flexible liquid separation media (105), which thereby positions the lower separation media float coupler (185) to rise and fall with the lower portion (105L) of flexible liquid separation media (105) without encumbrance of the lower separation media float coupler (185) around the vertical outer support column (120).

FIG. 5 shows a top view of one of the at least three of a vertical outer support column (120) within exterior liquid (110) with a liquid separation media support float (175) affixed to a lower portion (105L) of a flexible liquid separation media (105).

Shown in FIG. 5 are a lower portion (105L) of the flexible liquid separation media (105), one of an at least three of a vertical outer support column (120), a liquid separation media support float (175), a vertical float chamber (180), a lower separation media float coupler (185), a vertical slot (200) at least three of a vertical outer support column (120), and a lower media coupler (230) connecting the lower separation media float coupler (185) to a lower portion (105L) of flexible liquid separation media (105).

As discussed above, the at least three of a vertical outer support column (120) stands affixed in the exterior liquid (110), and has a vertical float chamber (180) which provides a hollow space for the liquid separation media support float (175) to rise and fall within the vertical float chamber (180). Unencumbered by other forces, the liquid separation media support float (175) would rest level with the level of the exterior liquid (110).

The liquid separation media support float (175) is attached to the lower separation media float coupler (185), which passes through a vertical slot (200) of the at least three of a vertical outer support column (120), with the lower separation media float coupler (185) attached to a lower media coupler (230), which is attached to a lower portion (105L) of the flexible liquid separation media (105).

Consequently, as a contained liquid (115) fills the flexible liquid separation media (105), the volume of the contained liquid (115) increases, causing the lower portion (105L) of the flexible liquid separation media (105) to sink into the exterior liquid (110), which pulls the liquid separation media support float (175) lower in the vertical float chamber (180) of the one of the at least three of a vertical outer support column (120). This filling of the flexible liquid separation media (105) also changes a changeable volume (220) within the flexible liquid separation media (105).

In this way, each liquid separation media support float (175) of each vertical outer support column (120) provides stability to the lower portion (105L) of the flexible liquid separation media (105) within the exterior liquid (110) and mitigates forces and pressures, such as currents, swells, etc. on the contained liquid (115), thereby mitigating the contained liquid (115) from ejection from the flexible liquid separation media (105) and to contain the contained liquid (115) within the flexible liquid separation media (105) and maintains the lower portion (105L) of the flexible liquid separation media (105) in its position relative to the liquid separation media upper edge (205) of the flexible liquid separation media (105) and the surface (245) of the contained liquid (115) maintains a consistent elevation difference below the liquid separation media upper edge (205) of the flexible liquid separation media (105).

For the flexible liquid separation media (105) to be substantially impermeable, the material and permeability of the flexible liquid separation media (105) should be balanced relative to the chemistries of contained liquid (115) and the exterior liquid (110) as to (1) is the priority to prevent the contained liquid (115) from passing into the exterior liquid (110) or is the priority to prevent the exterior liquid (110) from passing into the contained liquid (115), and (2) what contaminants are present and in what concentrations within the contained liquid (115) and exterior liquid (110) which would affect the choice of the material and permeability of the flexible liquid separation media (105).

These descriptions and drawings are embodiments and teachings of the disclosure. All variations are within the spirit and scope of the disclosure. This disclosure is not to be considered as limiting the claims to only the embodiments illustrated or discussed. Certain changes can be made in the subject matter without departing from the spirit and the scope of this invention. It is realized that changes are possible within the scope of this invention and it is further intended that each structure or element recited in any of the claims is to be understood as referring to all equivalent structure or elements. The following claims are intended to cover the invention as broadly as possible in whatever form it may be used.

What is claimed is:

1. An apparatus for storage of a changeable volume of a contained liquid within an exterior liquid, the apparatus comprising:

a flexible liquid separation media (105) configured as an atmospherically open enclosure within a media liquid flow barrier (210) as an upper portion and comprising a liquid separation media upper edge (205) of the media liquid flow barrier (210) and a lower portion (105L) of the flexible liquid separation media (105) to contain a changeable volume (220) of a contained liquid (115) within the flexible liquid separation media (105) as the flexible liquid separation media (105) fills from an empty condition to a full condition within an exterior liquid (110), an at least three of a vertical outer support column (120) for securely supporting the flexible liquid separation media (105) within the exterior liquid (110) while the contained liquid (115) is within the flexible liquid separation media (105), the at least three of a vertical outer support column (120) comprising a top end (125) with an upper end (130) of the at least three of a vertical outer support column (120) proximate to the top end (125), the at least three of a vertical outer support column (120) comprising a bottom end (135) with a lower end (140) of the at least three of a vertical outer support column (120) proximate to the bottom end (135), the at least three of a vertical outer support column (120) comprising a vertical float chamber (180) within the at least three of a vertical outer support column (120) and between the upper end (130) and the lower end (140), the at least three of a vertical outer support column (120) having a liquid separation media facing side (145) on which below the top end (125) of the at least three of a vertical outer support column (120) of at least one of the at least three of a vertical outer support column (120) has an affixed at least one support column coupler (160) coupled to an upper media support column connector (150) coupled to an upper affixment (235) below the liquid separation media upper edge (205) of the flexible liquid separation media (105), a liquid separation media support float (175) within the vertical float chamber (180) within the at least three of a vertical outer support column (120), and a lower separation media float coupler (185) coupled to the liquid separation media support float (175), the lower separation media float coupler (185) passing through a vertical slot (200) on the a liquid separation media facing side (145) of each of the at least three of a vertical outer support column (120) for coupling the liquid separation media support float (175) to a lower media coupler (230) affixed to the lower portion (105L) of the flexible liquid separation media (105) for the liquid separation media support float (175) to floatably anchor the lower portion (105L) of the flexible liquid separation media (105) to one of the at least three of a vertical outer support column (120), the liquid separation media support float (175) is configured to rise and fall within the vertical float chamber (180) for lowering and rising the lower media coupler (230) of the flexible liquid separation media (105) within the exterior liquid (110) commensurate with a changeable volume (220) of the contained liquid (115) within the flexible liquid separation media (105) as to mitigate current and swell effects on the lower portion (105L) of the flexible liquid separation media (105) and to mitigate unequal liquid forces of weight and pressure of the contained liquid (115) upon the flexible liquid separation media (105) and maintains the lower portion (105L) of the flexible liquid separation media (105) a consistent distance relative to the at least three of a vertical outer support column (120) so the lower portion (105L) sinks and rises without varying in horizontal distance from one of the at least three of a vertical outer support column (120) to which the lower portion (105L) is floatably anchored, and the lower portion (105L) of the flexible liquid separation media (105) sinks in the exterior liquid (110) as the changeable volume (220) of the contained liquid (115) increases within the flexible liquid separation media (105) and the lower portion (105L) of the flexible liquid separation media (105) rises in the exterior liquid (110) as the changeable volume (220) of the contained liquid (115) decreases within the flexible liquid separation media (105) and a surface (245) of the contained liquid (115) maintains a consistent elevation difference below the liquid separation media upper edge (205) of the flexible liquid separation media (105).

2. The apparatus of claim 1 wherein the flexible liquid separation media (105) is substantially impermeable to the contained liquid (115) within the flexible liquid separation media (105).

3. The apparatus of claim 1 wherein the flexible liquid separation media (105) is substantially impermeable to the exterior liquid (110) outside of the flexible liquid separation media (105).

4. The apparatus of claim 1 wherein the flexible liquid separation media (105) further comprises an upper horizontal support float (215) coupled to a media liquid flow barrier (210) below the liquid separation media upper edge (205) of the flexible liquid separation media (105) for supporting the liquid separation media upper edge (205) of the flexible liquid separation media (105) above the exterior liquid (110).

5. The apparatus of claim 1 wherein at least one of the at least three of a vertical outer support column (120) comprise a securing media facing side (155) attached to which is an at least one support column coupler (160) coupling at least one of the at least three of a vertical outer support column (120) to a support column upper securing media connector (165) for securing the at least one of the at least three of a vertical outer support column (120) to a securing media (170).

6. The apparatus of claim 5 wherein the securing media (170) comprises a land mass adjacent to the exterior liquid (110).

7. The apparatus of claim 1 further comprising a lower lateral support coupler (190) coupled at the lower end (140) of the vertical outer support column (120) proximate to the bottom end (135) for securing a lower securing media coupling connector (195) of at least one of the at least three of a vertical outer support column (120) to a securing media (170).

8. The apparatus of claim 7 wherein the securing media (170) comprises an embedded anchor (E) embedded in a land mass adjacent to the exterior liquid (110).

9. The apparatus of claim 7 wherein the securing media (170) comprises an anchor (SB) embedded below the exterior liquid (110).

10. The apparatus of claim 1 wherein the bottom end (135) of at least one of the at least three of a vertical outer support column (120) is secured to a bed (SB) below the exterior liquid (110).

11. The apparatus of claim 1 further comprising an at least one weight (240) positioned on the lower portion (105L) of the flexible liquid separation media (105) as to mitigate unequal liquid forces of weight and pressure of the exterior liquid (110) and the contained liquid (115) upon the flexible liquid separation media (105).

12. The apparatus of claim 1 wherein the at least three of a vertical outer support columns (120) are positionally coupled to the flexible liquid separation media (105) and to a securing media (170) as to distribute liquid forces of weight and pressure of the contained liquid (115) within the flexible liquid separation media (105) with respect to the exterior liquid (110) and the securing media (170) as to mitigate unequal liquid forces of weight and pressure of the contained liquid (115) upon the flexible liquid separation media (105) and the at least three of a vertical outer support columns (120).

13. The apparatus of claim 1 wherein the at least three of a vertical outer support columns (120) are substantially equidistance from each other.

14. The apparatus of claim 1 wherein the top end (125) of the at least one of the at least three of a vertical outer support column (120) provides a staging area for attachment of monitors, sensors, and ancillary equipment to at least one of the at least three of a vertical outer support column (120).

15. The apparatus of claim 1 wherein the at least one of the at least three of a vertical outer support column (120) comprise a diameter between 2 inches and 24 inches.

16. The apparatus of claim 1 wherein the at least one of the at least three of a vertical outer support column (120) comprise a pipe of a diameter over 24 inches.

17. The apparatus of claim 1 wherein the flexible liquid separation media (105) comprises a material selected from the group consisting of polyvinylchloride (PVC), polypropylene (PP), polyethylene (PE), polytetrafluoroethylene (PTFE), polyvinylidene fluoride (PVDF), nylon (NYL), and polyethersulfone (PES).

18. The apparatus of claim 1 wherein the liquid separation media support float (175) comprises a ball comprising a plastic material.

19. The apparatus of claim 1 wherein the flexible liquid separation media (105) is capable of accommodating the changeable volume (220) of increasing and decreasing volumes of contained liquid (115) so that at the surface (245) of the contained liquid (115) at an atmospheric interface (AIR) and the exterior liquid (110), the surface of the contained liquid (115) and of the exterior liquid (110) are level to each other as the volume of contained liquid (115) changes within the flexible liquid separation media (105) and to withstand environmental effects of the exterior liquid (115) and pressure of the contained liquid (115) while filling and holding the contained liquid (115).

* * * * *